US007453037B2

(12) United States Patent
Ishii et al.

(10) Patent No.: US 7,453,037 B2
(45) Date of Patent: Nov. 18, 2008

(54) MUSICAL PERFORMANCE APPARATUS

(75) Inventors: Jun Ishii, Hamamatsu (JP); Yasuhiko Oba, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 669 days.

(21) Appl. No.: 11/107,795

(22) Filed: Apr. 18, 2005

(65) Prior Publication Data

US 2005/0235808 A1 Oct. 27, 2005

(30) Foreign Application Priority Data

Apr. 22, 2004 (JP) ..... P 2004-127143
Jul. 12, 2004 (JP) ..... P 2004-205039

(51) Int. Cl.
*G10H 1/00* (2006.01)
*G10F 1/02* (2006.01)

(52) U.S. Cl. ..... 84/600; 84/21

(58) Field of Classification Search ..... 84/13, 84/21, 600

See application file for complete search history.

(56) References Cited

U.S. PATENT DOCUMENTS 5,022,301 A 6/1991 Stahnke
6,121,535 A * 9/2000 Muramatsu ..... 84/626
7,259,319 B2 * 8/2007 Oba et al. ..... 84/744

FOREIGN PATENT DOCUMENTS

JP 57-170648 10/1982
JP 04-75096 3/1992
JP H06-214560 8/1994

* cited by examiner

*Primary Examiner*—Jeffrey Donels
(74) *Attorney, Agent, or Firm*—Dickstein Shapiro LLP

(57) ABSTRACT

A musical performance apparatus has an I/O unit including a digital signal processor (DSP) and a plurality of application-specific integrated circuits (ASIC), which are connected together in a cascade connection manner and each of which includes a plurality of shift registers. The DSP produces drive signals for driving a plurality of operators (e.g., keys and pedals) based on performance data. In synchronization with a serial clock signal, drive signals are transferred in a serial manner from the DSP to the shift registers. In synchronization with a word sync signal based on the serial clock signal, detection signals representing displacements of the operators are transferred in parallel to the shift registers, which in turn output drive signals in parallel. Both of the serial clock signal and word sync signal are produced using a single clock generator.

12 Claims, 8 Drawing Sheets

WS
CONTROL OPERATION
dx
dr
DR
DX
DSP
A/D
SHIFT
PWM
(LATCH CIRCUIT)
n-1 (PWM)
n (PWM)
n+1 (A/D)
n+2 (A/D)
n+3 (A/D)
n-2 (PWM)

MUSICAL PERFORMANCE APPARATUS

BACKGROUND OF THE INVENTION

1. Field of the Invention

This invention relates to musical performance apparatuses such as player pianos that perform feedback controls individually with respect to operators such as pedals and keys in accordance with performance information.

This application claims priorities on Japanese Patent Applications Nos. 2004-127143 and 2004-205039, the contents of which are incorporated herein by reference.

2. Description of the Related Art

Conventionally, various types of musical performance apparatuses such as player pianos have been developed and designed such that operators such as keys and pedals are individually driven by feedback controls based on displacements thereof in accordance with performance information, thus realizing automatic performance.

Japanese Patent Application Publication No. H06-214560 discloses time-sharing servo controls with respect to a musical performance apparatus, wherein in the precondition that generally-known player pianos are each limited to have sixteen tone-generation channels for simultaneously generating musical tones, time-sharing servo controls are performed on the limited number of actuators, which are selected and not actually used in musical practice within a plurality of actuators subjected to servo controls in parallel, whereby it is possible to reduce the load of servo processing and the number of circuits, thus realizing a simple constitution for controlling numerous actuators.

However, the aforementioned musical performance apparatus has the limited number of operators that can be simultaneously controlled; hence, it has difficulty in coping with simultaneous generation of numerous musical tones due to recent developments of technologies regarding electronic musical instruments. Strictly speaking, time-sharing processing (or time-division processing) may produce deviations regarding control timings for various operators. Such a problem may apparently occur as the number of operators is increased; hence, it is strongly demanded to further develop musical performance apparatuses in controlling numerous operators in real time.

U.S. Pat. No. 5,022,301 discloses a musical performance apparatus (namely, a reproducing piano) in which key drive data are produced based on performance data and are supplied to latch circuits via shift registers having steps corresponding to keys; then, the key drive data are applied to solenoids for driving keys by means of decoders in response to outputs of three pulse-width modulators (see FIGS. 1 and 7), wherein in the pulse-width modulator, a comparator compares a triangular wave generated by a triangular-wave generator and an output of a timing control circuit.

In the aforementioned musical performance apparatus, the timing control circuit requires a clock generator for determining the transfer timing regarding the key drive data, and the triangular wave generator also requires a clock generator in order to generate a triangular wave having a prescribed frequency.

That is, the performance control system of the aforementioned musical performance apparatus needs to have two 'independent' clock generators in order to realize automatic performance. This makes the performance control system complicated.

In addition, the performance control system may require a buffer in order to establish synchronization with respect to input/output operations regarding key drive data in the automatic performance that is realized based on independent clock signals. This causes relatively large delays between samples regarding performance controls, which may be therefore deteriorated in response and become unstable.

SUMMARY OF THE INVENTION

It is an object of the invention to provide a musical performance apparatus that can perform feedback controls on numerous operators with a simple constitution, regardless of the limited number of operators being simultaneously controlled.

It is another object of the invention to provide a musical performance apparatus having a simple performance control system by reducing the number of clock signals therefore.

In a first aspect of the invention, a musical performance apparatus includes a plurality of operators such as keys and pedals; a plurality of drivers, each of which is independently controlled, for driving the plurality of operators respectively; a plurality of sensors for detecting displacements regarding the plurality of operators so as to produce detection signals; a digital signal processor (DSP) for processing performance data so as to produce drive signals (PWM values) for the plurality of drivers and for outputting a word sync signal (WS) based on a serial clock signal (SCK); and a plurality of integrated circuits (i.e., ASIC), each of which receives the drive signals in a serial manner from the digital signal processor in synchronization with the serial clock signal, each of which receives the detection signals in parallel in synchronization with the word sync signal, and each of which outputs the drive signals in parallel in synchronization with the word sync signal.

In the above, the ASIC includes a plurality of blocks, each of which includes an input terminal, an analog-to-digital converter, a shift register for receiving and holding the drive signal, a latch circuit, and an output terminal.

In a second aspect of the invention, both of the serial clock signal and word sync signal used in the aforementioned musical performance apparatus are produced using a single clock generator. This reduces the number of clock generators, which in turn simplifies the constitution of the performance control system, wherein no buffer is required for establishing synchronization between serial input operations and parallel output operations in the ASIC; hence, it is possible to reduce sample delays in performance control, so that the performance control system is improved in response and is stabilized in operation.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

1. First Embodiment

Figure 1:
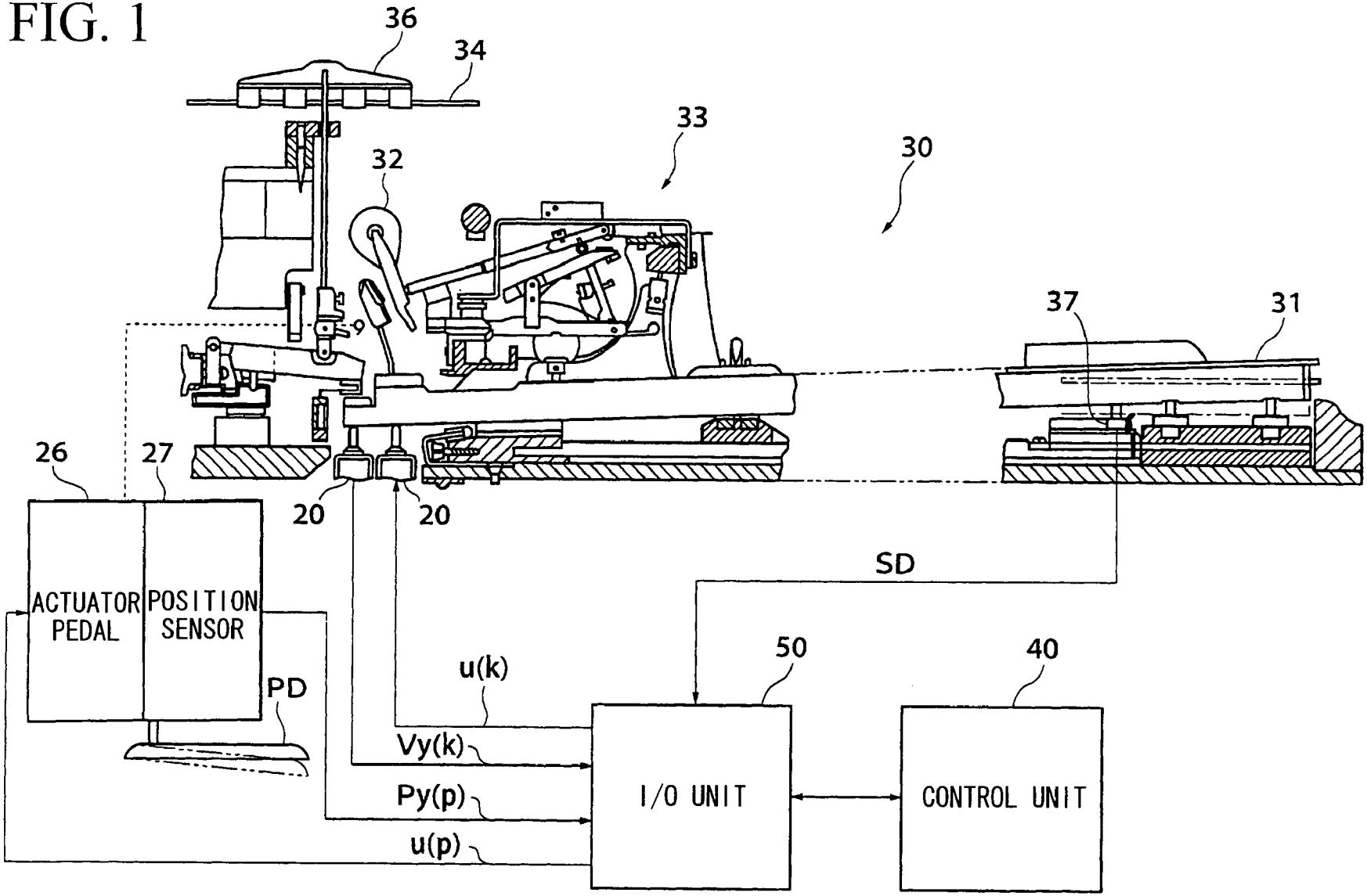
FIG. 1 is a fragmentary cross-sectional view showing the mechanism of a musical performance apparatus in accordance with a first embodiment of the invention.

FIG. 1 is a fragmentary cross-sectional view showing the mechanism of a musical performance apparatus (such as a player piano, referred to as a keyboard musical instrument) equipped with electronic controls with respect to each single key. A keyboard assembly 30 has the mechanism similar to that adapted to conventionally-known acoustic pianos, wherein it includes an action mechanism 33 for transmitting the motion of a key 31 to a hammer 32, a string (or strings) 34 that is struck by the hammer 32, and a damper 36 for suspending vibration of the string 34 with respect to each single key 31. For the sake of convenience, the player's side close to the key 31 will be referred to as a front side.

A key drive unit 20 having a solenoid coil (not shown) is arranged beneath the rear end portion of the key 31. A key sensor unit 37 is arranged beneath the front side of the key 31, wherein it produces a detection signal SD (i.e., an analog signal) representing the position of the key 31 that is moved within a prescribed stroke.

When a drive signal is supplied to the key drive unit 20 corresponding to a tone pitch defined by tone-generation event data included in performance data, a plunger is moved upwards so that the top portion thereof comes in contact with the backside of the rear end portion of the key 31, which is thus projected upwardly. That is, the front portion of the key 31 is mechanically depressed so that the hammer 32 strikes the string 34 so as to generate a piano sound having the corresponding tone pitch. The key drive unit 20 is equipped with a velocity sensor (not shown) that detects the velocity of the movement of the plunger.

The keyboard assembly 30 is equipped with a pedal PD for driving the damper 36. In addition, it is also equipped with a pedal actuator 26 for driving the pedal PD and a position sensor 27 for detecting the position of the pedal PD. The pedal actuator 26 has the known constitution (details of which are not shown), wherein it has a plunger 29 interconnected with the pedal PD and a solenoid coil 28 wound about the plunger 29 (see FIG. 2), and wherein the plunger 29 is operated to drive the pedal PD in response to a drive signal supplied thereto.

The keyboard assembly 30 is further equipped with a control unit 40 and an input/output (I/O) unit 50. The control unit 40 sends and receives signals with respect to the I/O unit 50. For example, it sends performance data and synchronization signals to the I/O unit 50. Performance data are configured by MIDI codes (where 'MIDI' represents the standard for Musical Instrument Digital Interface), thus controlling operations of the key 31 and the pedal PD.

The I/O unit 50 receives a detection signal SD from the key sensor unit 37 and a position detection signal Py(p) from the position sensor 27 as well as a velocity detection signal Vy(k) from a velocity sensor included in the key drive unit 20. Based on the performance data, the position detection signal Py(p), and the detection signal SD, the I/O unit 50 produces excitation currents having current values u(p) and u(k), which are respectively supplied to the pedal actuator 26 and the key drive unit 20. Specifically, the current value u(p) corresponds to a pulse-width modulated (PWM) signal whose pulse width is modulated to match a prescribed duty ratio regarding a target value of an average current flowing through the solenoid coil of the pedal actuator 26. Similarly, the current value u(k) corresponds to a PWM signal whose pulse width is modified to match a prescribed duty ratio regarding a target value of an average current flowing through the solenoid coil of the key drive unit 20.

In automatic performance based on performance data, the I/O unit 50 compares position control data, which are produced based on the performance data so as to represent the position of the pedal PD and the position of the key 31 at each prescribed timing, with digital values of the position detection signal Py(p) and the detection signal SD, which are subjected to analog-to-digital conversion, whereby the current values u(p) and u(k) are adequately updated so that the position control data match the digital values, thus realizing servo controls. That is, the pedal PD and the key 31 are driven in accordance with the performance data, thus realizing the automatic performance. The present embodiment is designed to use the detection signal SD for the feedback control of the key 31. It is possible to replace the detection signal SD with the velocity detection signal Vy(k); or it is possible to use the velocity detection signal Vy(k) in addition to the detection signal SD. Details of the I/O unit 50 will be described later.

Figure 2:
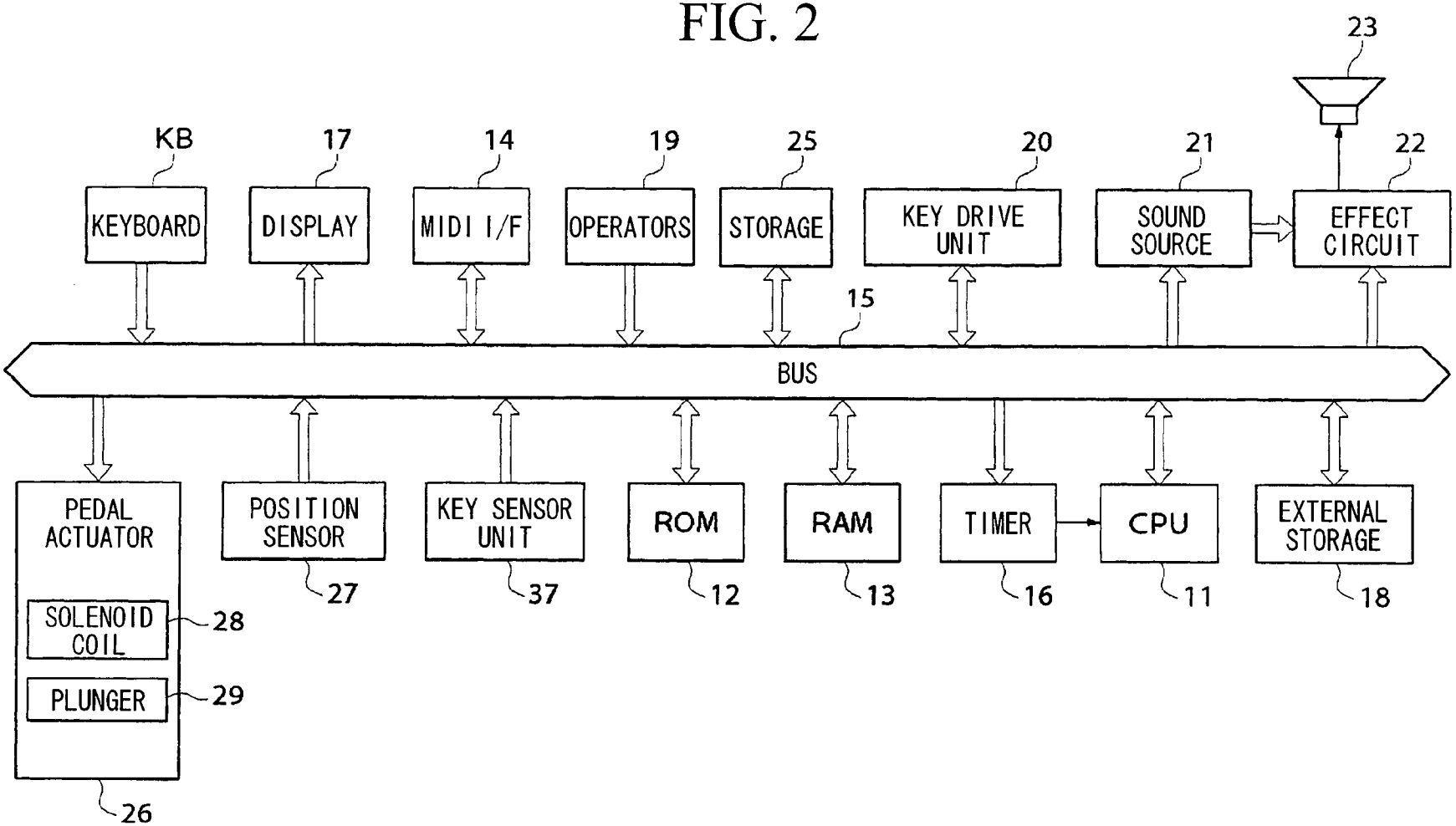
FIG. 2 is a block diagram showing the constitution of the musical performance apparatus.

FIG. 2 is a block diagram showing the constitution of a control mechanism of the keyboard assembly 30.

The control mechanism of the keyboard assembly 30 has a CPU 11, which is connected with the key drive unit 20, pedal actuator 26, position sensor 27, and key sensor unit 37 and is also connected with a keyboard KB, a ROM 12, a RAM 13, a MIDI interface (abbreviated as "MIDI I/F") 14, a timer 16, a display 17, an external storage 18, operators 19, a sound source 21, an effect circuit 22, and a storage 25 via a bus 15. The sound source 21 is connected with a sound system 23 via the effect circuit 22.

The CPU 11 performs overall control on the keyboard assembly 30. The ROM 12 stores control programs executed by the CPU 11 as well as table data and various data. The RAM 13 temporarily stores various pieces of input information such as performance data and text data, various flags, buffer data, and calculation results. The MIDI interface 14 receives performance data from a MIDI device (not shown) in the form of MIDI signals. The timer 16 measures various times such as interrupt times used in timer interrupt processes. The display 17 is constituted using a liquid-crystal display (LCD), for example, wherein it displays various pieces of information such as musical scores. The external storage 18 is accessible to portable storage media (not shown) such as flexible disks, on which it can read and write various data such as performance data. The operators 19 includes various types of operators (not shown), which designate start/stop operations, tune selecting operations, and setups with regard to automatic performance, for example. The storage 25 is constituted by a non-volatile memory such as a flash memory, which can store various data such as performance data. The keyboard KB includes a prescribed number of keys, each of which is designated by the reference numeral 31 in FIG. 1.

The sound source 21 converts performance data into musical tone signals. The effect circuit 22 imparts various effects to musical tone signals output from the sound source 21. The sound system 23, which includes a digital-to-analog converter (DAC), an amplifier, and a speaker, converts effect-imparted musical tone signals into acoustic sounds.

The functions of the control unit 40 and the I/O unit 50 are realized by the cooperation between the CPU 11, timer 16, ROM 12, and RAM 13.

Figure 3:
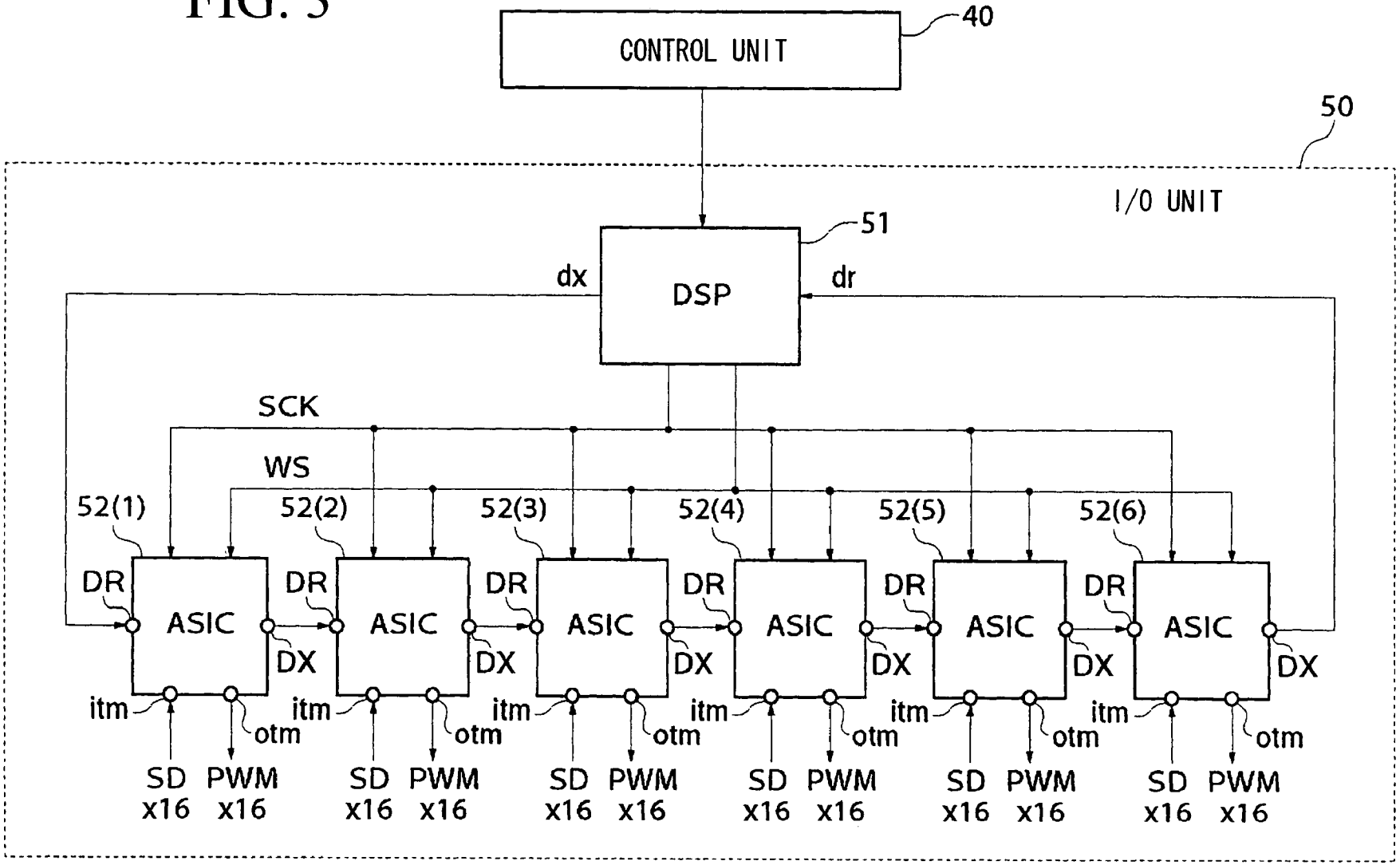
FIG. 3 is a block diagram showing the internal configuration of an I/O unit connected with a control unit shown in FIG. 1.

FIG. 3 is a block diagram showing the internal configuration of the I/O unit 50 connected with the control unit 40.

The I/O unit 50 includes a digital signal processor (abbreviated by "DSP") 51 and six sets of ASIC (i.e., "application-specific integrated circuit") 52(1) to 52(6), wherein for the sake of convenience, each ASIC is designated by the same reference numeral '52'.

Each ACIC 52 has the same configuration that has sixteen input terminals itm(1) to itm(16) (each designated by the same reference symbol 'itm', see FIG. 4) for inputting binary digits of the detection signal SD in parallel, and sixteen output terminals otm(1) to otm(16) (each designated by the same reference symbol 'otm', see FIG. 4) for outputting the current values u(p) and u(k) in parallel. Hereinafter, the current value u(k), which corresponds to drive information, will be referred to as "PWM value". With regard to drive control of the key 31, each input terminal itm is connected with the key sensor unit 37, and each output terminal otm is connected with the key drive unit 20.

Each ACIS 52 has a data transmission terminal (namely, a data exclusive terminal) DX for outputting serial data to an external device and a data reception terminal (namely, a data receive terminal) DR for inputting serial data from an external device. As shown in FIG. 3, all the six ASICs 52 are connected together in such a cascade connection manner that the terminals DX and DR are mutually connected together. Details of the ASIC 52 will be described later.

In the present embodiment, the keyboard KB has eighty-eight keys (each designated by the same reference numeral '31'), whereby the six ASICS 52 cooperate to realize input/output operations with regard to ninety-six channels. Specifically, the ASICS 51(1) to 52(6) are arranged to sequentially cope with the keys 31 from the lower register to the upper register such that each of them is assigned with sixteen keys counted from the lower note. A part of the remaining channels is assigned to the pedal PD, which is thus driven based on the position detection signal Py(p). The control of the pedal PD is similar to that of the key 31; hence, the following description will be given with respect to the key 31, whereas the description regarding the control of the pedal PD will be omitted.

The control unit 40 sends performance data, which are stored in the storage medium (i.e., the external storage device 18) or which are supplied thereto from an external device via the MIDI interface 14, to the DSP 51 included in the I/O unit 50. The DSP 51 generates a serial clock signal SCK (8 MHz) and a word sync signal WS, which are delivered to the ASICS 52(1) to 52(6) respectively.

Figure 4:
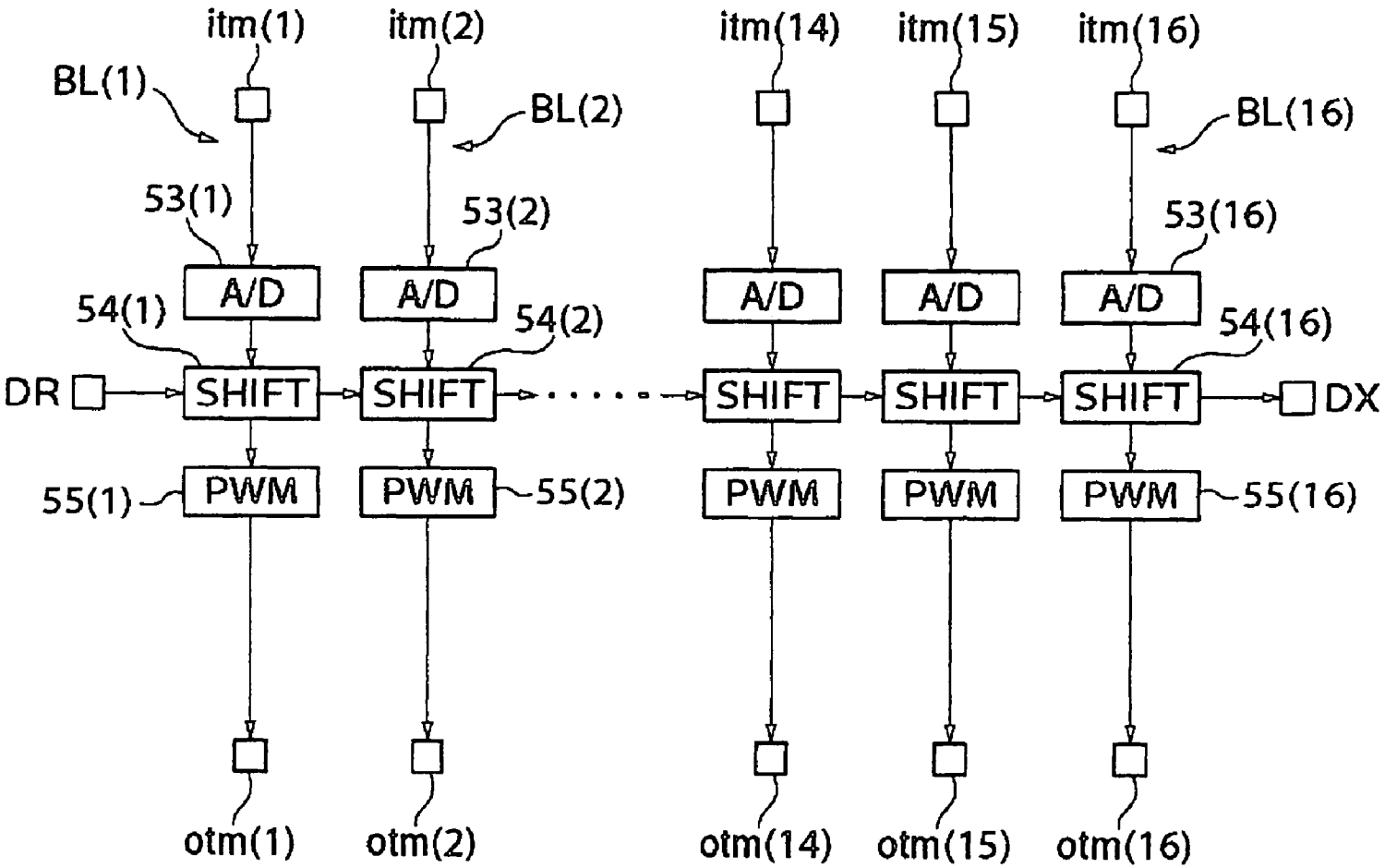
FIG. 4 is a circuit diagram showing the internal configuration of each ASIC included in the I/O unit shown in FIG. 3.

FIG. 4 is a circuit diagram showing the internal configuration of each ASIC 52, which has sixteen blocks BL(1) to BL(16), wherein each single block 'BL' corresponds to a pair of the input channel itm and the output channel otm. Therefore, the sixteen blocks BL(1) to BL(16) of each ASIC 52 correspond to sixteen keys 31.

Each ASIC 52 has various terminals (not shown) in addition to the input terminal itm, output terminal otm, data transmission terminal DX, and data reception terminal DR. For example, it has a terminal 'WS' for inputting the word sync signal WS, a terminal 'SCK' for inputting the serial clock signal SCK, and other terminals connected with the power source and ground potential (not shown).

The block BL(1) includes an input terminal itm(1), an A/D converter 53(1), a shift register (SHIFT) 54(1), a latch circuit (PWM) 55(1), and an output terminal otm(1), which are connected in series. Each of the other blocks BL(2) to BL(16) is constituted similar to the block BL(1). Herein, an A/D converter 53 (representing each of A/D converters 53(1) to 53(16)) handles 10 bits; a shift register 54 (representing each of shift registers 54(1) to 54(16)) handles 16 bits; and a latch circuit 55 (representing each of latch circuits 55(1) to 55(16)) handles 9 bits.

All the blocks BL(1) to BL(16) are connected together such that the shift registers 54 belonging to the adjacent blocks are connected in series. In addition, the data reception terminal DR is connected to the input terminal of the shift register 54(1) included in the block BL(1), and the data transmission terminal DX is connected to the output terminal of the shift register 54(16) included in the block BL(16).

At the trailing-edge timing of the serial clock signal SCK, all bits of the shift register 54 are shifted by one bit, so that the last bit is transferred to the next register as its top bit. The A/D converter 53 performs analog-to-digital conversion on the detection signal SD input by the input terminal itm so as to held the result thereof. At the trailing-edge timing of the word sync signal WS, all bits of the A/D converter 53 are transferred to the shift register 54; all bits of the shift register 54 are transferred to the latch circuit 55; and all bits of the latch circuit 55 are output to the output terminal otm.

In the present embodiment, each ASIC 52 has a capability of performing serial input/output operations and a capability of performing parallel input/output operations with regard to sixteen channels. Next , input/output operations of the ASIC 52 will be described blow.

A single trailing edge of the word sync signal WS occurs every time trailing edges of the serial clock signal SCK occur 1536 times (where 1536=16 (channels) ×6(ASICs)×16 (bits)). Herein, data processing can be described below.

As shown in FIG. 3, the DSP 51 supplies the data reception terminal DR of the ASIC 52(1) with a PWM value in a serial manner via an output terminal dx thereof in accordance with the trailing-edge timing of the serial clock signal SCK. In addition, the DSP 51 receives digital physical information (hereinafter, referred to as "A/D value"), which is produced through analog-to-digital conversion performed on the detection signal SD (corresponding to analog physical information), in a serial manner from the data transmission terminal DX of the ASIC 52(6) the detection signal via an input terminal dr thereof. As described above, the PWM value corresponds to the current value u(k), which is produced based on the performance data and the A/D value in the DSP 51. This operation can be explained in a time-series manner below.

Figures 5A, 5B, 5C, 5D, 5E, 5F:
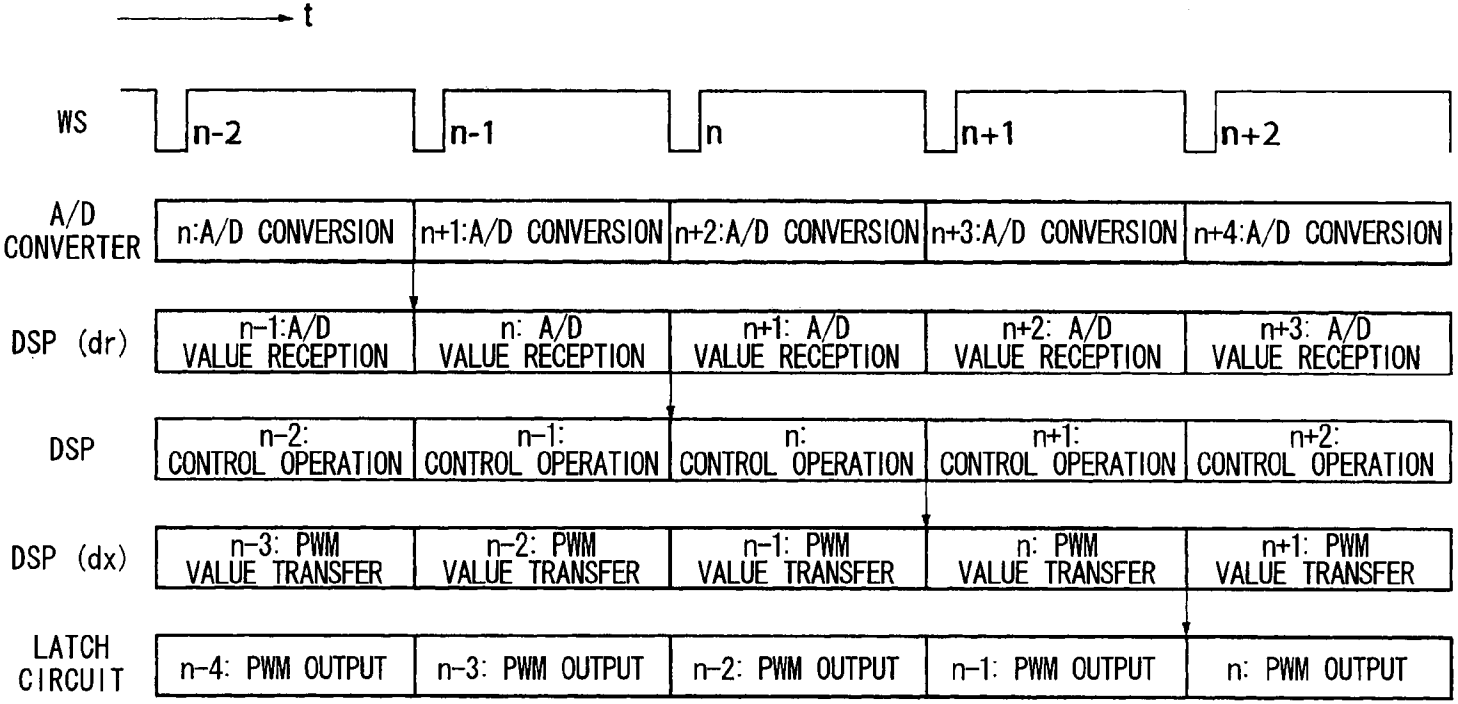
FIG. 5A is a time chart showing a word sync signal WS.
FIG. 5B is a time chart showing processing of an A/D converter included in the ASIC.
FIG. 5C is a time chart showing data reception regarding a DSP included in the I/O unit shown in FIG. 3.
FIG. 5D is a time chart showing processing of the DSP.
FIG. 5E is a time chart showing data transmission regarding the DSP.
FIG. 5F is a time chart showing processing of a latch circuit included in the ASIC.

FIGS. 5A to 5F are time charts showing data processing executed in the I/O unit 50, wherein time progression occurs from the left to the right with respect to time 't'. FIG. 5A shows trailing-edge timings of a word sync signal WS. FIG. 5B shows processing in the A/D converter 53. FIGS. 5C to 5E show processing in the DSP 51. FIG. 5F shows processing in the latch circuit 55. FIGS. 6A to 6D schematically show data processing in the I/O unit 50 including six ASICs 52, wherein "A/D" designates the collection of six A ID converters 53; "SHIFT" designates the collection of six shift registers 54; and "PWM" designates the collection of six latch circuits 55.

In the above, 'n' designates a plurality of data (i.e., a data group) subjected to control operation (i.e., calculation for producing PWM values based on performance data and A/D values) in the DSP 51 at the trailing-edge timing 'n' of the word sync signal WS. In FIGS. 6A to 6D, expressions in parenthesis such as (A/D) and (PWM) are described under 'n', 'n+1', and 'n+2', each of which designates a specific data group, so as to designate A/D values and PWM values for the corresponding data groups.

Figures 6A, 6B, 6C, 6D:
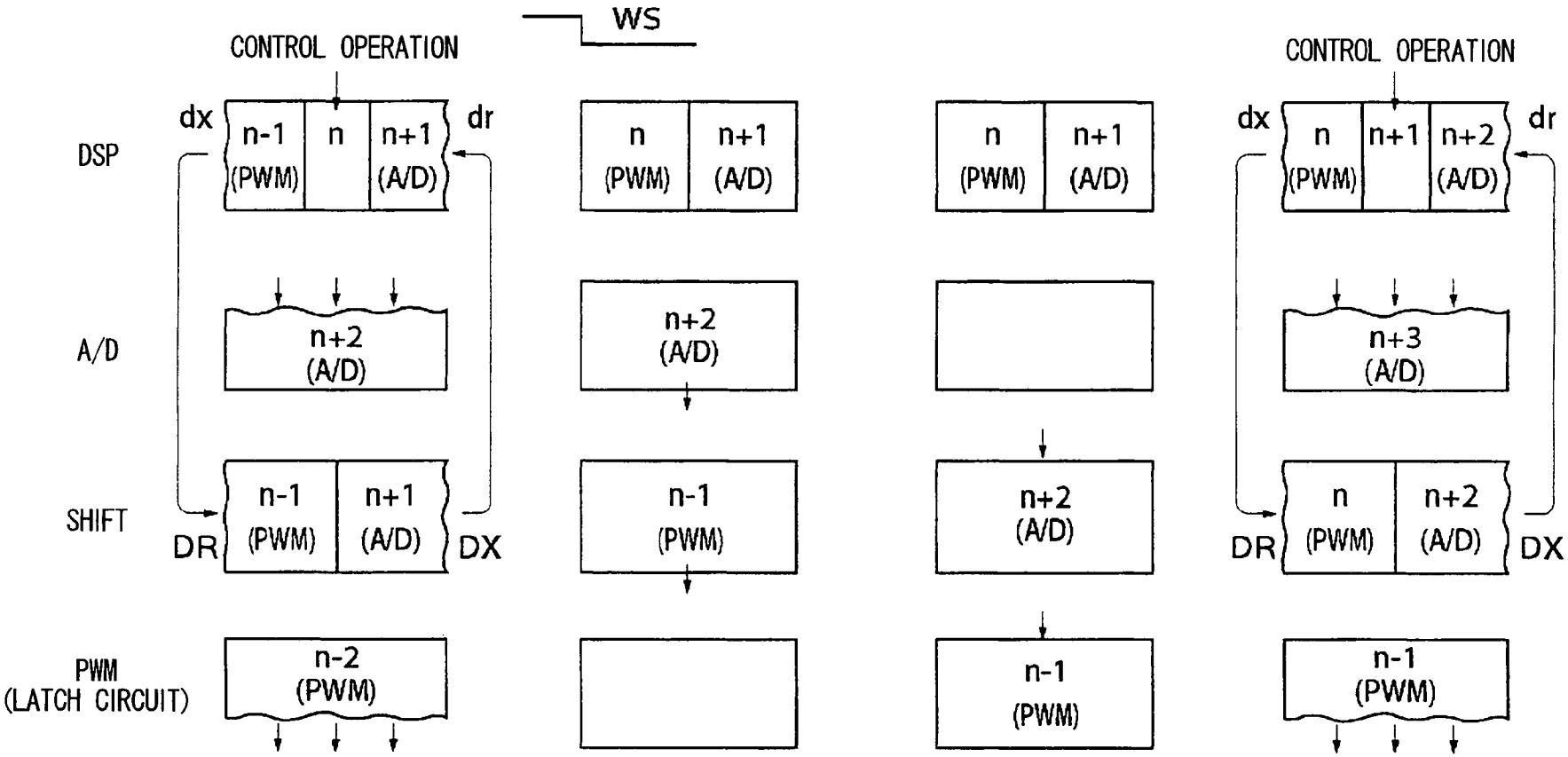
FIG. 6A schematically shows a first step of processing with regard to the DSP and the ASIC.
FIG. 6B schematically shows a second step of processing with regard to the DSP and the ASIC.
FIG. 6C schematically shows a third step of processing with regard to the DSP and the ASIC.
FIG. 6D schematically shows a fourth step of processing with regard to the DSP and the ASIC.

As shown in FIG. 6A, in parallel with the control operation regarding the data group 'n' in the DSP 51 (see the third column "n: CONTROL OPERATION" in FIG. 5D), the following operations are performed in synchronization with the serial clock signal SCK.

First, a data group 'n−1' that is completed in control operation and is thus converted into a PWM value is transferred in a serial manner from the output terminal dx of the DSP 51 to the data reception terminal DR of the ASIC 51(1). This is shown in the third column "n−1: PWM VALUE TRANSFER" in FIG. 5E. All bits of the data group 'n−1' received by the data reception terminal DR are shifted one by one in the shift register 54, whereby all bits of the data group 'n+1', which were previous converted into an A ID value and held in the shift register 54, were shifted one by one, so that they are transferred in a serial manner from the data transmission terminal DX of the ASIC 52(6) to the input terminal dr of the DSP 51. This is shown in the third column "n+1: A/D VALUE RECEPTION" in FIG. 5C.

In parallel to the aforementioned operations, the A/D converters 53(1) to 53(16) included in each ASIC 52 collectively receive all bits of the analog detection signal SD in parallel via the input terminals itm(1) to itm(16) (see FIG. 4), wherein they are subjected to analog-to-digital conversion so as to produce an A/D value with regard to the data group 'n+2' before the next trailing-edge timing 'n+1' of the word sync signal WS. This is shown in the third column "n+2: A/D CONVERSION" in FIG. 5B. In addition, the latch circuits 55(1) to 55(16) included in each ASIC 52 collectively output all bits of the data group 'n−2', which were converted into a PWM value and held therein, to the output terminals otm(1) to otm(16) (see FIG. 4) before the next trailing-edge timing of the word sync signal WS. This is shown in the third column "n−2: PWM OUTPUT" in FIG. 5F.

As described above, before the next trailing-edge timing of the word sync signal WS, as shown in FIG. 6B, the data groups 'n' and 'n+1' are held in the DSP 51; the data group 'n+2' is held in the A/D converters 53; the data group 'n−1' is held in the shift registers 54. As shown in FIGS. 6B and 6C, at the trailing-edge timing 'n+1' of the word sync signal WS, the data group 'n−1' is transferred from the shift registers 54 to the latch circuits 55, and the data group 'n+2' is transferred from the A/D converters 53 to the shift registers 54. Therefore, at each trailing-edge timing of the word sync signal WS, it is possible to update the duty ratio of the current value u(k) for controlling the key drive unit 20.

Thereafter, as shown in FIG. 6D, the data group currently subjected to processing is updated. Then, the similar operations, which are described above in conjunction with FIG. 6A, are repeated until the next trailing-edge timing of the word sync signal WS.

According to the present embodiment, in synchronization with the serial clock signal SCK, PWM values are transferred in a serial manner from the DSP 51 to the shift registers 54 with respect to 96 channels, and A/D values held in the shift registers 54 are transferred in a serial manner to the DSP 51. At the trailing-edge timing of the word sync signal WS, the shift registers 54 collectively input all bits of the detection signal SD in parallel, and PWM values held in the shift registers 54 are collectively output in parallel. This indicates that serial/parallel transfer operations of A/D values simultaneously serve as serial/parallel transfer operations of PWM values in the shift registers 54. That is, the shift registers 54 simultaneously perform two functions with regard to transfer operations of A/D values and PWM values. In other words, the present embodiment can be simplified in circuit configuration compared with the circuitry that includes two sets of shift registers individually used for transfer operations regarding A/D values and PWM values. In addition, the present embodiment is advantageous compared with the conventionally known time-sharing system because it does not produce time deviations regarding detection and drive of each individual key 1. Therefore, even when the musical performance apparatus is equipped with numerous operators that are controlled to simultaneously generate chords, it is possible to realize real-time musical performance with a high precision. In short, the present embodiment demonstrates real-time feedback control on numerous operators with a simple circuit configuration, regardless of the limited number of operators that can be simultaneously controlled.

The number of 'controllable' channels can be easily changed by changing the number of blocks BL included in each ASIC 52 or by changing the number of ASICs 52 included in the I/O unit 50. Alternatively, it can be easily changed by modifying control algorithms in the DSP 51. This improves the compatibility and universality among musical performance apparatuses. The present embodiment is not necessarily limited to musical performance apparatuses having keyboard assemblies; hence, it can be adapted to any types of apparatuses having capabilities of performing music using operators.

The present embodiment merely requires parallel transfer operations of PWM values and A/D values to be collectively performed at the prescribed timing, which is not necessarily limited to the trailing-edge timing of the word sync signal WS.

The detection signal SD corresponds to position data representing the key-depression position of the key 31. Of course, feedback control is not necessarily performed using the detection signal SD. For example, it is possible to use other parameters (e.g., velocity and acceleration) regarding the displacement of the key 31. In addition, the detection signal SD, A/D values, and PWM values are not restrictive in the present embodiment, which can thus process other data.

2. Second Embodiment

The second embodiment is basically similar to the first embodiment as shown in FIGS. 1, 3, 5A-5F, and 6A-6D; hence, the detailed description thereof will be omitted as necessary.

Figure 7:
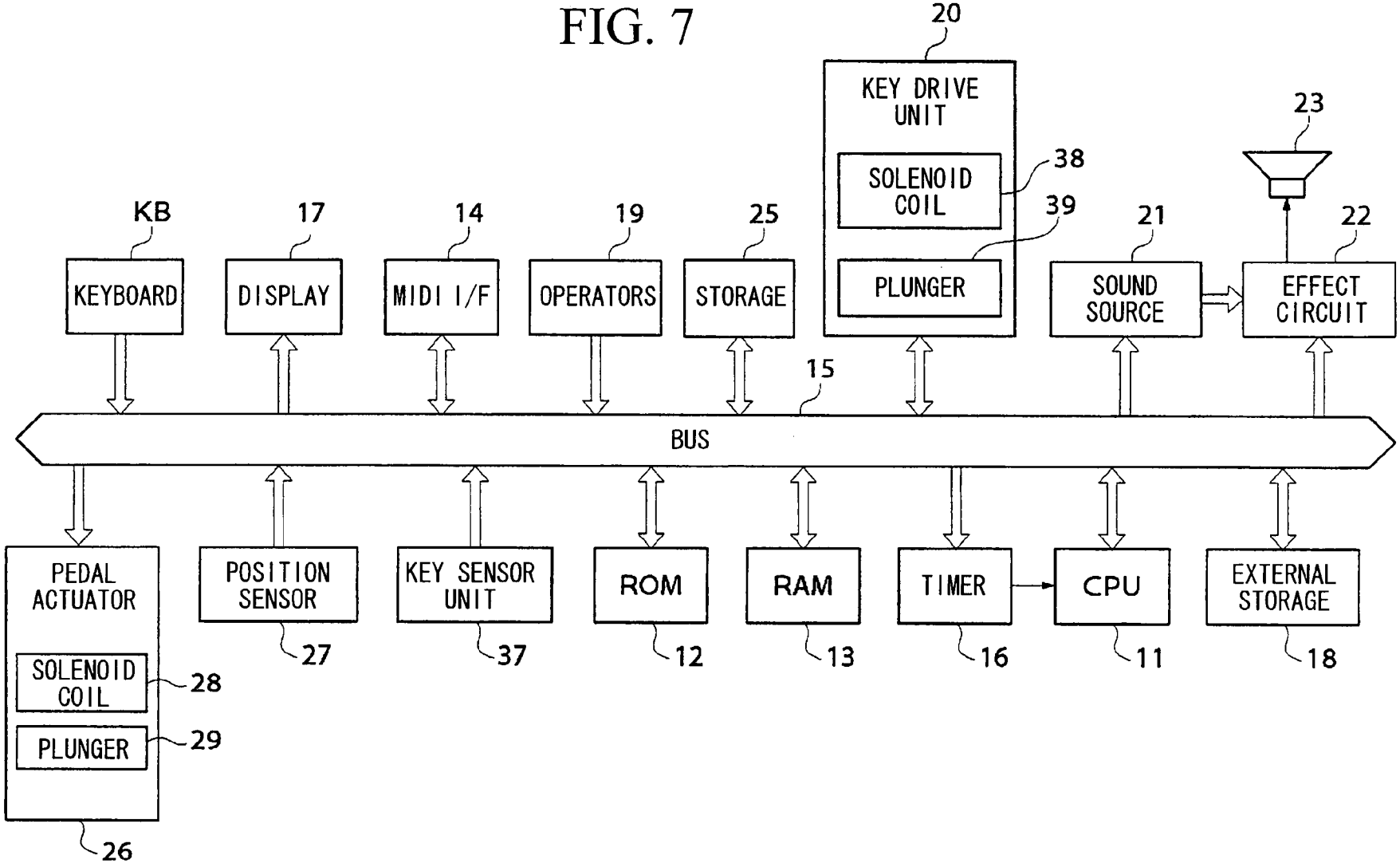
FIG. 7 is a block diagram showing the constitution of a musical performance apparatus in accordance with a second embodiment of the invention.

FIG. 7 is a block diagram showing the control mechanism of the keyboard assembly 30, wherein compared with the aforementioned block diagram shown in FIG. 2, the key drive unit 20 includes a solenoid 38 and a plunger 39. In addition, connection lines in the I/O unit 50 are configured by three-line buses such as $I^2S$ buses allowing transmission of digital musical tone signals.

Figure 8:
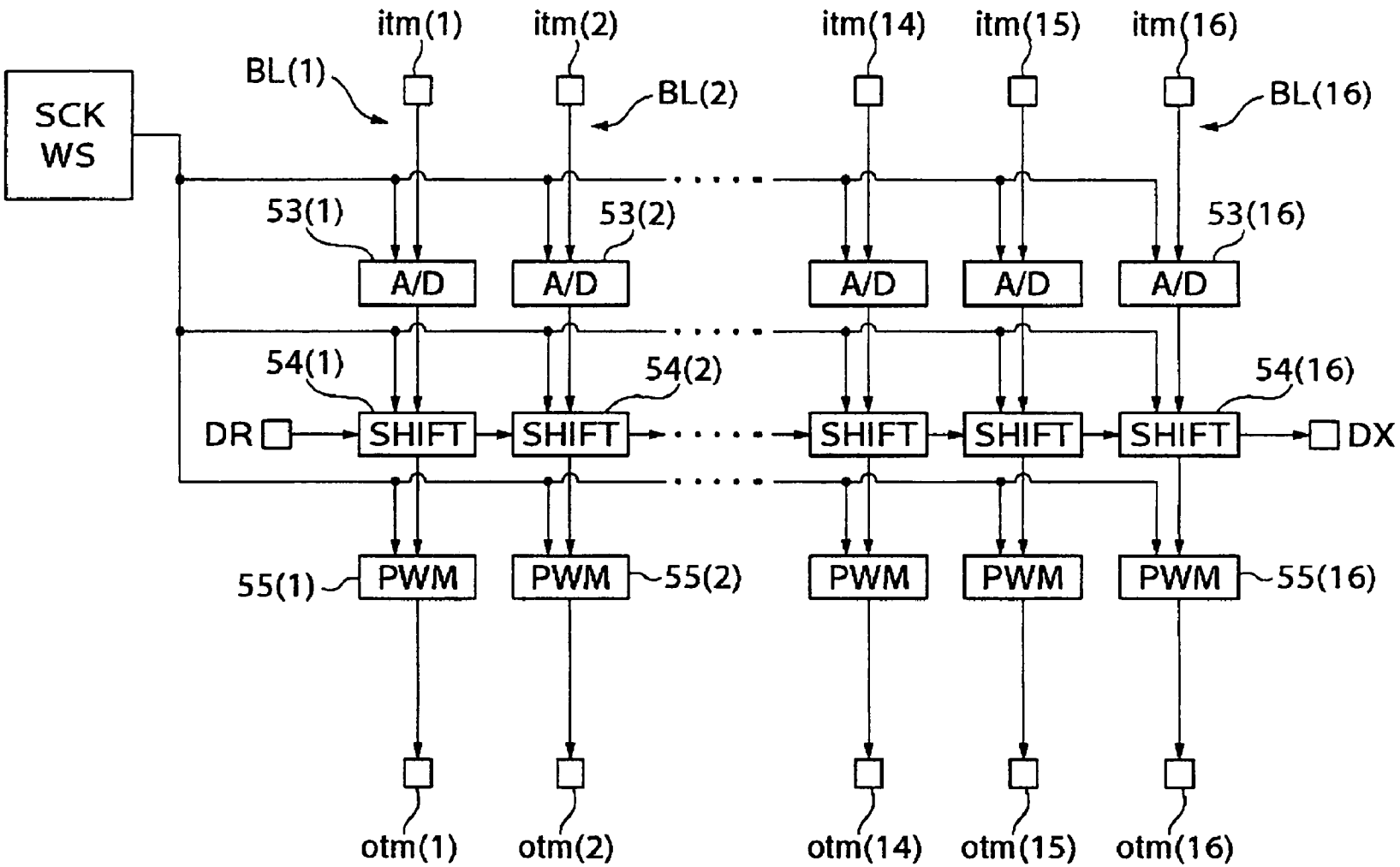
FIG. 8 is a circuit diagram showing the internal configuration of each ASIC included in an I/O unit used in the musical performance apparatus of the second embodiment.

FIG. 8 is a circuit diagram showing the internal configuration of each ASIC included in the I/O unit 50, wherein the DSP 51 supplies each ASIC 52 with a serial clock signal SCK and a word sync signal WS, which are supplied to A/D converters 53, shift registers 54, and latch circuits 55 respectively.

A single trailing edge of the word sync signal WS occurs at each time when trailing edges of the serial clock signal SCK occur 1536 times (where 1536=16(channels)×6×16 (bits)). In the second embodiment, both of the serial clock signal SCK and the word sync signal WS are produced based on the oscillation of a single timer 16, whereby the word sync signal WS synchronizes with the serial clock signal SCK whose frequency is set to 8 MHz, for example.

The second embodiment basically operates as similar to the first embodiment as shown in FIGS. 5A to 5F and FIGS. 6A to 6D.

The second embodiment is characterized in terms of the setup how to determine the system clock frequency defining parallel input timings of A/D values and parallel output timings of PWM values as well as the communication clock frequency defining data transfer timings between the DSP 51 and the ASIC 52.

To suppress noise and to secure satisfactory control precision, it is preferable that PWM values be controlled at 16 KHz or so, whereby resolutions of pulse widths are expressed in 9 bits, that is, they are controlled in 512 steps (equals $2^9$). For this reason, the system clock signal SCK(sys) is determined as follows:

$$SCK\ (sys)=2^9\times16(KHz)$$

According to this equation, the system clock signal SCK (sys) is set to 8192 KHz.

In order to realize so-called "rapidly consecutive hitting" of keys 31 in musical performance, it is preferable that with respect to data transfer, the number of frames be set to 5000 per second or more, that is, the frequency regarding trailing edges of the word sync signal WS be set to 5000 per second or more. As to the data rate per a single channel, it is preferable that resolutions of PWM values be defined in 9 bits or more, wherein they are generally expressed using the multiple of '8'; hence, the present embodiments sets the data rate per a single channel to be defined in 16 bits. The number of channels that can be processed in a single frame (defined between trailing edges of the word sync signal WS) is set to 96. Therefore, the communication clock SCK(com) is determined as follows:

$$SCK\ (com)=16\ (bit/channel)\times96\ (channel/frame)\times5000\ (frame/second)$$

According to this equation, the communication clock SCK (com) is set to 7680 KHz, which is close to 8192 KHz of the system clock SCK(sys). Herein, both of the communication clock SCK(com) and the system clock SCK(sys) are close to 8000 KHz. The second embodiment sets that both of the communication clock SCK(com) and the system clock SCK (sys) are set to 8000 KHz, i.e., 8 MHz, whereby "16 KHz" and "5000 (frame/second)" used in the aforementioned equations are correspondingly corrected. Specifically, PWM values are controlled in response to the corrected values, i.e., 15.625 KHz and 5208 (frame/second).

The second embodiment is characterized in that both of the system clock SCK(sys) and the communication clock SYS (com) are determined in common, so that serial transfer operations and parallel output operations of PWM values are performed at prescribed timings based on the serial clock signal SCK. Compared with the system in which they are performed independently based on different clock signals, the present embodiment is advantageous because it does not require the system clock specifically used for the ASIC 52. That is, it is possible to reduce the number of clock generators, thus simplifying the constitution of the performance control system.

In the aforementioned system in which serial transfer operations and parallel output operations of PWM values are performed independently based on different clock signals, it is necessary to provide buffers realizing synchronization therebetween between shift registers 54 and latch circuits 55, for example. This makes the system configuration complicated, and this adds one sample delay to performance control. That is, it becomes necessary for the I/O unit 50 to simultaneously process six data groups, whereas the I/O unit 50 can simultaneously process five data groups at maximum in time series. This reduces the response of the performance control. In contrast to the aforementioned system, the present embodiment can reduce the number of sample delays in performance control; hence, it is possible to improve the response of the performance control system, which is thus stabilized.

In addition, the second embodiment is characterized in that both of the system clock SCK(sys) and the communication clock SCK(com) are determined in common, whereby parallel input operations of A/D values in the ASIC 52 and serial transfer operations of A/D values from the ASIC 52 to the DSP 51 are performed at prescribed timings based on the same serial clock signal SCK. This eliminates an independent system clock to be specifically arranged for the ASIC 52 with respect to input operations of A/D values. In this aspect, the present embodiment can simplify the constitution of the performance control system.

In the system in which each ASIC 52 is equipped with the 'independent' system clock SCK(sys), it is difficult to adjust trailing-edge timings regarding PWM values between ASICs 52. Hence, it is very difficult to intentionally control trailing-edge timings of numerous ASICs 52 not to coincide with each other. In the present embodiment in which all ASICs 52 operate based on the 'common' system clock SCK(sys), it is possible to slightly shift trailing-edge timings of PWM values between the ASICs 52. That is, the present embodiment has an advantage to desirably adjust trailing-edge timings of PWM values between the ASICs 52. This makes it possible to avoid the occurrence of problems such as voltage drops in advance.

Incidentally, A/D converters of the flash type do not require clock generators. In that case, it is unnecessary to supply A/D converters 53 with the serial clock signal SCK and the word sync signal WS.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A musical performance apparatus comprising:

a plurality of operators;

a plurality of drivers, each of the plurality of drivers is independently controlled and drives the plurality of operators, respectively;

a plurality of sensors that detect displacements regarding the plurality of operators so as to produce detection signals;

a digital signal processor that processes performance data so as to produce drive signals for the plurality of drivers, the digital signal processor outputs a word sync signal based on a serial clock signal; and a plurality of integrated circuits, wherein each of the plurality of integrated circuits receives the drive signals in a serial manner from the digital signal processor in synchronization with the serial clock signal, receives the detection signals in parallel in synchronization with the word sync signal, and outputs the drive signals in parallel in synchronization with the word sync signal.

2. A musical performance apparatus according to claim 1, wherein each of the plurality of integrated circuits is configured as an application-specific integrated circuit comprising a plurality of blocks.

3. A musical performance apparatus according to claim 2, wherein both the serial clock signal and the word sync signal are produced using a single clock generator.

4. A musical performance apparatus according to claim 1, wherein each of the plurality of blocks comprises an input terminal coupled to an analog-to-digital converter, which is coupled to a shift register that receives and holds the drive signal, wherein the shift register is coupled to a latch circuit, which is coupled to an output terminal.

5. A musical performance apparatus according to claim 4, wherein in synchronization with the serial clock signal, the drive signals are transferred in a serial manner from the digital signal processor to the shift registers, and digital values, which are output from the analog-to-digital converters and are held in the shift registers, are transferred in a serial manner to the digital signal processor.

6. A musical performance apparatus according to claim 5, wherein both the serial clock signal and the word sync signal are produced using a single clock generator.

7. A musical performance apparatus according to claim 4, wherein both the serial clock signal and the word sync signal are produced using a single clock generator.

8. A musical performance apparatus according to claim 1, wherein the plurality of operators correspond to a plurality of keys.

9. A musical performance apparatus according to claim 1, wherein both the serial clock signal and the word sync signal are produced using a single clock generator.

10. A musical performance apparatus according to claim 1, wherein the plurality of operators correspond to a plurality of pedals.

11. A musical performance apparatus according to claim 1, wherein the plurality of operators correspond to a plurality of keys and plurality of pedals.

12. A musical performance apparatus according to claim 1, wherein the plurality of operators correspond to a plurality of keys or a plurality of pedals.

* * * * *